US010397716B2

(12) United States Patent
Janßen

(10) Patent No.: US 10,397,716 B2
(45) Date of Patent: Aug. 27, 2019

(54) SYSTEMS AND METHODS FOR MONITORING AND CONTROLLING SOUND LEVELS

(71) Applicant: Novar GmbH, Neuss (DE)

(72) Inventor: Robin Janßen, Düsseldorf (DE)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/831,964

(22) Filed: Dec. 5, 2017

(65) Prior Publication Data

US 2019/0174241 A1 Jun. 6, 2019

(51) Int. Cl.
*H04R 29/00* (2006.01)
*H04S 7/00* (2006.01)

(52) U.S. Cl.
CPC ..... *H04R 29/002* (2013.01); *H04S 7/301* (2013.01)

(58) Field of Classification Search
CPC ..... H04R 29/002; H04S 7/301
USPC ..... 381/56
See application file for complete search history.

(56) References Cited

U.S. PATENT DOCUMENTS

2002/0145521 A1 10/2002 Chou et al.
2008/0159547 A1 7/2008 Schuler et al.
2009/0052677 A1* 2/2009 Smith ..... H04R 29/008 381/56
2009/0180631 A1 7/2009 Michael et al.
2013/0329863 A1 12/2013 Bentley et al.
2014/0362999 A1 12/2014 Scheper et al.
2015/0110276 A1 4/2015 Gereb

FOREIGN PATENT DOCUMENTS

JP H0785386 A 3/1995

OTHER PUBLICATIONS

Extended Search Report from related European Application No. 18185406, dated Feb. 12, 2019, 7 pages.

* cited by examiner

*Primary Examiner* — Paul Kim
(74) *Attorney, Agent, or Firm* — Brooks, Cameron & Huebsch, PLLC

(57) ABSTRACT

Systems and methods for monitoring and controlling sound levels across multiple regions are provided. Some systems and methods may include a sound level sensor in a first region determining a sound level within the first region for sound originating from a source in a second region and a sound level display device in the second region displaying a visual indicator of the sound level in the first region. Additionally or alternatively, some systems and methods may include controlling a volume level of the source.

20 Claims, 3 Drawing Sheets

SYSTEMS AND METHODS FOR MONITORING AND CONTROLLING SOUND LEVELS

FIELD

The present invention relates generally to systems and methods for monitoring and controlling sound levels. More particularly, the present invention relates to systems and methods for monitoring a sound level within a first region for sound originating from a source in a second region and controlling the source in the second region or displaying a warning in the second region about the sound level within the first region.

BACKGROUND

Known systems and methods for monitoring and controlling sound levels across multiple regions require a user at a region remote from a source of sound to manually notify users at the source of the sound of a loud volume. Furthermore, such systems and methods rely on warning users occupying a region in which the sound is emitted of dangerous or overly loud sound levels rather than notifying a user at the source of the sound or automatically lowering the dangerous or overly loud sound levels to an acceptable volume.

In view of the above, there is a continuing, ongoing need for improved systems and methods.

DETAILED DESCRIPTION

Figure 1:
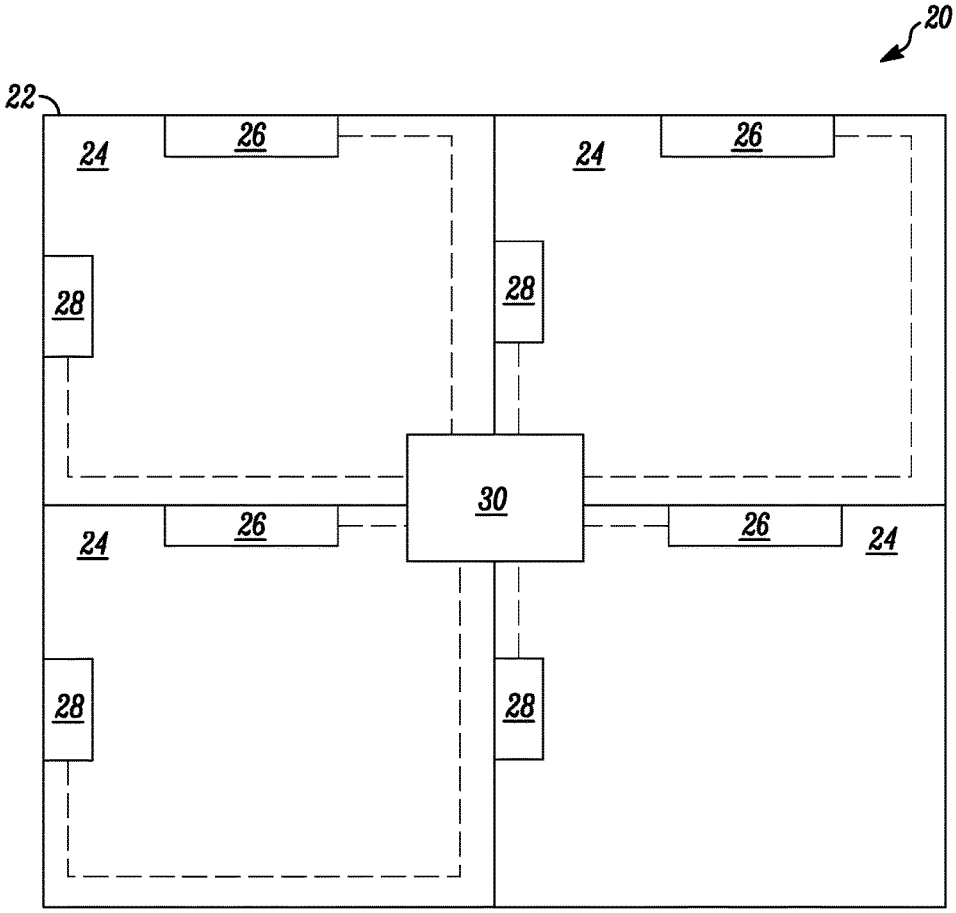
FIG. 1 is a block diagram of a sound control and monitoring system in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein may include systems and methods for monitoring and controlling sound levels across multiple regions of a premises. For example, systems and methods disclosed herein may include each of a plurality of regions of the premises including a respective one of a plurality of sound level sensors and a respective one of a plurality of sound level display devices.

Systems and methods as disclosed herein may be deployed as standalone devices interacting together or as a part of home automation systems or security systems. It is to be understood that such systems can include, but are not limited to systems that include a control panel in communication with the plurality of sound level sensors and the plurality of sound level display devices.

In accordance with disclosed embodiments, the plurality of sound level sensors and the plurality of sound level display devices may be deployed throughout the premises. In some embodiments, the plurality of sound level sensors may be ceiling mounted, wall mounted, or embedded alongside existing sensor devices (e.g. fire detectors, thermostats, smoke detectors, carbon monoxide detectors, etc.). In some embodiments, the plurality sound level sensors may include any known device for monitoring a sound level. For example, in some embodiments, the plurality of sound level sensors may include microphones for use in measuring other parameters, such as direction. Additionally or alternatively, in some embodiments, direction may be determined by comparing the sound level monitored at multiple ones of the plurality of sound level sensors deployed in the same region or in close proximity. In some embodiments, the plurality of sound level sensors may include mobile devices (e.g. smart phones, tablets, handheld devices, etc.) exchanging data in a mesh network. The premises may be subdivided into the plurality of regions, and each of the plurality of regions may include the respective one of the plurality of sound level sensors and the respective one of the plurality of sound level display devices. In some embodiments, each of the plurality of regions may correspond to a room of the premises or a section of the room in an open concept floor plan.

In accordance with disclosed embodiments, the respective one of the plurality of sound level sensors in a first one of the plurality of regions may determine a respective sound level within the first one of the plurality of regions for sound originating from a source located in a second one of the plurality of regions. Furthermore, in some embodiments, the respective one of the plurality of sound level display devices in the second one of the plurality of regions may display an indicator of the respective sound level within the first one of the plurality of regions. For example, in some embodiments, the indicator may include a pictographical or numerical rendering of the respective sound level detected within the first one of the plurality of regions. Additionally or alternatively, in some embodiments, the indicator may include a visual indicator, such as an illuminated light or warning beacon that the respective sound level within the first one of the plurality of regions has exceeded a threshold value. Additionally or alternatively, in some embodiments, the indicator may be transmitted to a portable user device located in the second one of the plurality of regions. Additionally or alternatively, in some embodiments, the indicator may be displayed on a map at a location corresponding to the first one of the plurality of regions within the premises.

In some embodiments, the respective one of the plurality of sound level sensors in the first one of the plurality of regions may determine a direction of the sound detected within the first one of the plurality of regions and use the direction to identify the second one of the plurality of regions. However, irrespective of how the second one of the plurality of regions is identified, the respective one of the plurality of sound level sensors in the first one of the plurality of regions may send first data indicative of the respective sound level within the first one of the plurality of regions to the respective one of the plurality of sound level display devices in the second one of the plurality of regions, and the respective one of the plurality of sound level display devices in the second one of the plurality of regions may display the indicator of the respective sound level within the first one of the plurality of regions in responsive thereto.

In some embodiments, the respective one of the plurality of sound level sensors in the first one of the plurality of regions may send the first data indicative of the respective sound level within the first one of the plurality of regions and any associated parameters measured by the respective one of the plurality of sensors in the first one of the plurality of regions to a control panel. The control panel may use the first data and/or the associated parameters to identify the second one of the plurality of regions in which the source of the sound is located and send second data indicative of the respective sound level within the first one of the plurality of regions to the respective one of the plurality of sound level display devices in the second one of the plurality of regions. In some embodiments, the control panel may frequency weight data indicative of the respective sound level within the first one of the plurality of regions to discriminate against low frequency sounds.

In some embodiments, the control panel may establish a respective threshold value for each of the plurality of regions. For example, the control panel may employ a calibration procedure using standardized test signals emitted into each of the plurality of regions by sources coupled to the control panel, the plurality of sound level display devices, the plurality of sound level sensors, or other third party devices deployed at least temporarily in the plurality of regions. In some embodiments, the standardized test signals may be emitted from audible alarm devices incorporated as part of a fire detection system. Each of the plurality of sound level sensors in a respective one of the plurality of regions may detect the standardized test signals emitted into the respective one of the plurality of regions and any other background noise in the respective one of the plurality of regions, and the control panel may set the respective threshold value for the respective one of the plurality of regions at a level that is equal to the respective sound level of a combination of the background noise and the standardized test signals that is detected by each of the plurality of sound level sensors in the respective one of the plurality of regions. In some embodiments, the threshold value may be automatically adjusted based on local rules, the time of day, and/or the day of the week.

In some embodiments, the calibration procedure may include determining the attenuation of the test signals between each of the plurality of regions and/or within a predefined 3d direction system (e.g. north, east, south west, above, and below). For example, the sound level or sound pressure level for a test signal emitted in a first one of the plurality of regions may be known and the attenuation value for the other plurality of regions can be determined by finding the difference between the sound level of the test signal emitted within the first one of the plurality of regions and respective sound levels measured at each of the other plurality of regions during the time the test signal is emitted within the first one of the plurality of regions. Additionally or alternatively, in some embodiments, if no attenuation value for one of the plurality of regions is known the control panel or the respective one of the plurality of sensor devices for that region may estimate or locate the loudest sound in that region and lower the sound level value to below the respective threshold value for that region. Additionally or alternatively, in some embodiments, the control panel may retrieve the location data of each of the plurality of sensor device and devices used to generate the test signals from a building map, indoor navigation data, or radio cell data from a telecom/network provider and may utilize the location data in completing the calibration procedure.

In some embodiments, the control panel may determine whether the respective sound level within the first one of the plurality of regions exceeds the respective threshold value for the first one of the plurality of regions and whether the source of the sound in the second one of the plurality of regions is controllable by the control panel. When the respective sound level within the first one of the plurality of regions exceeds or is equal to the respective threshold value for the first one of the plurality of regions and the source of the sound in the second one of the plurality of regions is controllable by the control panel, the control panel may automatically lower a volume level of the source to a level that causes the respective sound level within the first one of the plurality of regions to be lowered to a level that is below the respective threshold value for the first one of the plurality of regions. However, when the respective sound level within the first one of the plurality of regions exceeds or is equal to the respective threshold value for the first one of the plurality of regions and the source of the sound in the second one of the plurality of regions is not controllable, the control panel may send the second data indicative of the sound level within the first one of the plurality of regions to the respective one of the plurality of sound level display devices in the second one of the plurality of regions, and the second data may include a sound alert warning signal. In some embodiments, the control panel may determine that the level within the first one of the plurality of regions exceeds or is equal to the respective threshold value when the sound level exceeds or is equal to the respective threshold value multiple times within a defined time window (e.g. three times in five minutes).

In some embodiments, the control panel or the respective one of the plurality of sound level sensor devices within the first one of the plurality of regions may determine the presence of a user within the first one of the plurality of regions. In such embodiments, the control panel or the respective one of the plurality of sound level sensor devices within the first one of the plurality of regions may forward the sound level to the respective sound level display in the second one of the plurality of regions or lower the volume of the source when the user is detected and may take no action if the user is not detected. In some embodiments, the control panel or the respective one of the plurality of sound level sensor devices may detect the presence of the user by detecting sound levels below the respective threshold value. Additionally or alternatively, in some embodiments, secondary sensors (e.g. motion sensors, cameras, heat sensors, etc.) may be used to detect the presence of the user in the first one of the plurality of regions.

In some embodiments, multiple ones of the plurality of sound level sensors in multiple ones of the plurality of regions may detect the sound from the source in a single one of the plurality of regions. In these embodiments, each of the multiple ones of the plurality of sound level sensors may individually determine whether the respective sound level in the respective one of the plurality of regions exceeds the respective threshold value, and the respective one of the plurality of sound level display devices in the single one of the plurality of regions in which the source of the sound is located may display the sound alert signal warning signal when the respective sound level in any of the multiple ones of the plurality of regions exceeds the respective threshold value for the respective one of the plurality of regions. In some embodiments, the control panel may determine whether the respective sound level in any of the multiple ones of the plurality of regions exceeds or is equal to the respective threshold value for the respective one of the plurality of regions and may send the sound alert warning signal to the respective one of the plurality of sound level display devices in the single one of the plurality of regions or may lower the volume level of the source as described herein.

FIG. 1 is a block diagram of a sound control and monitoring system 20 in accordance with disclosed embodiments. As shown in FIG. 1, the system 20 may be deployed in a premises 22, and the premises 22 may be subdivided into a plurality of regions 24 such that each of the plurality of regions 24 may include a respective one of a plurality of sound level sensors 26 and a respective one of a plurality of sound level display devices 28. In some embodiments, each of the plurality of sound level sensors 26 and each of the plurality of sound level display devices 28 may be coupled to a control panel 30, and in some embodiments, each of the plurality of sound level sensors 26 and each of the plurality of sound level display devices 28 may communicate directly with each other via wired or wireless signals.

Figure 2:
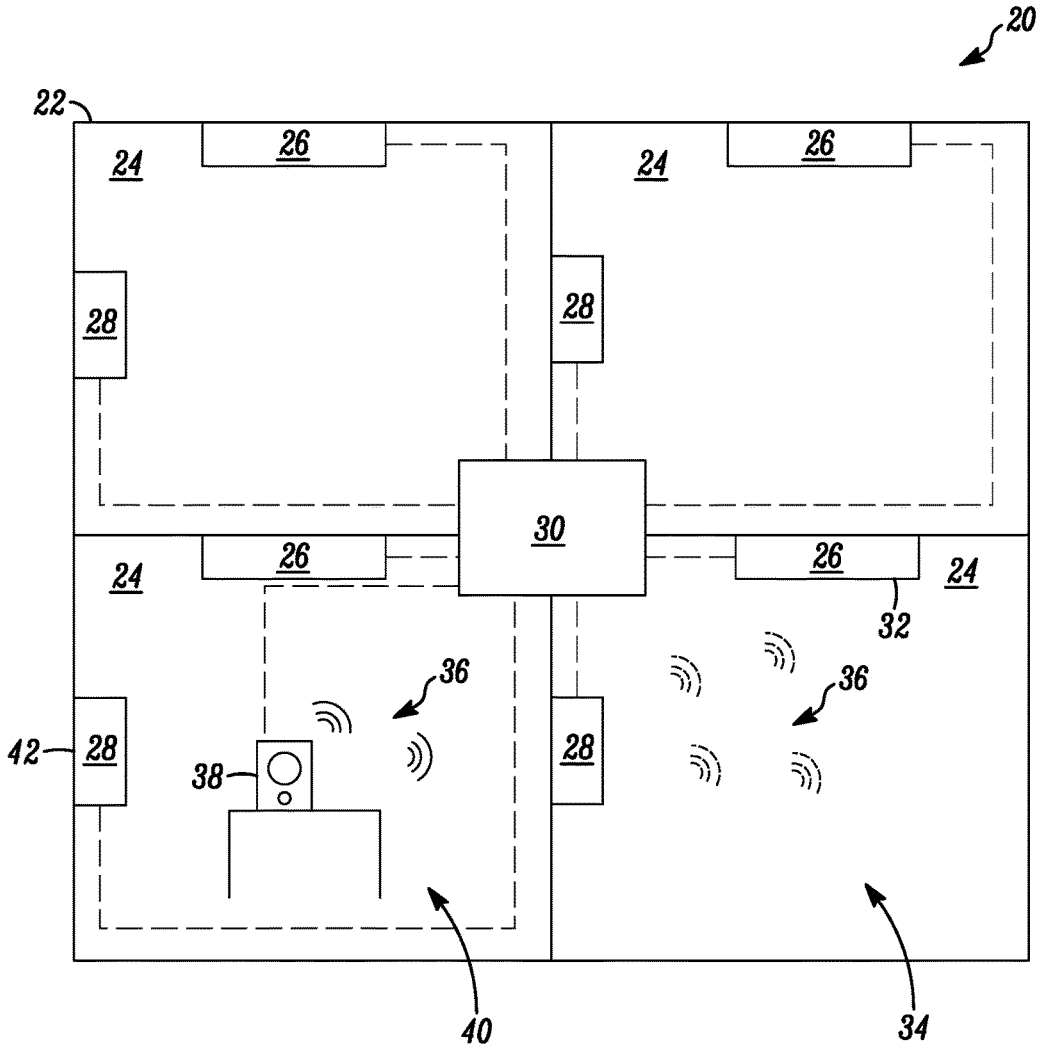
FIG. 2 is a block diagram of a sound control and monitoring system in accordance with disclosed embodiments.
Figure 3:
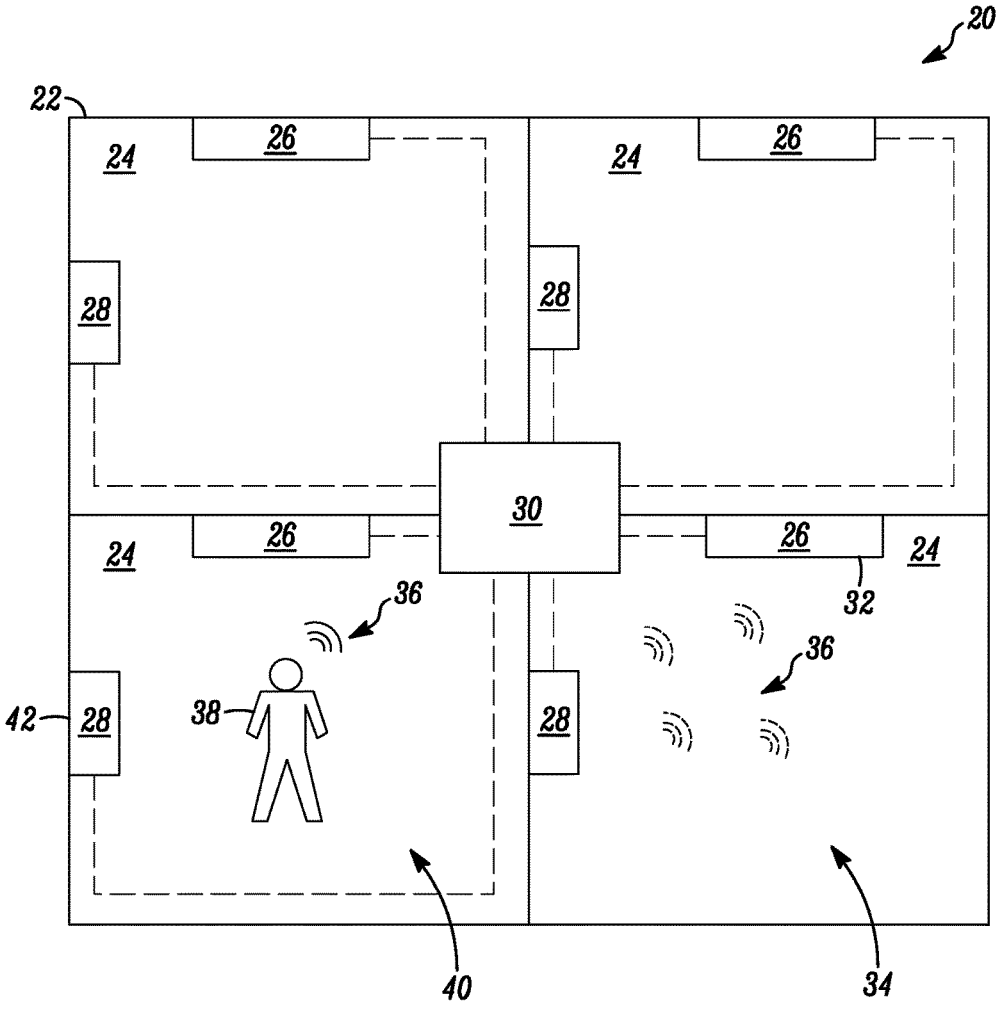
FIG. 3 is a block diagram of a sound control and monitoring system in accordance with disclosed embodiments.

FIG. 2 and FIG. 3 are block diagrams of the system 20 in accordance with disclosed embodiments. As shown in FIG. 2 and FIG. 3, a respective sound level sensor 32 in a first region 34 may detect a sound 36 originating a source 38 located in a second region 40, the respective sound level sensor 32 may transmit sound level data and additional parameters to the control panel 30, the control panel 30 may identify the second region 40 based on the sound level data and/or the additional parameters, and the control panel 30 may transmit additional data to the source 38 or to a respective sound level display 42 in the second region 40. As shown in FIG. 2, in some embodiments, the source 38 may be connected to and controllable by the control panel 30, and in these embodiments, the control panel 30 may transmit the additional data to the source 38 to automatically lower a volume of the source 38 to a level that causes a sound level of the sound 36 within the first region 34 to be below a predetermined threshold value. Additionally or alternatively, as shown in FIG. 3, the source 38 may be a person or a device not connected to the control panel 30, and in these embodiments, the control panel 30 may transmit the additional data to the respective sound level display 42 in the second region 40 to display a sound level warning or an indication of the sound level in the first region 34 until the sound level in the first region 34 is lower than the predetermined threshold value.

Although a few embodiments have been described in detail above, other modifications are possible. For example, the steps described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A system comprising:

a plurality of sound level sensors deployed throughout a premises; and a plurality of sound level display devices deployed throughout the premises, wherein the premises includes a plurality of regions, wherein each of the plurality of regions includes a respective one of the plurality of sound level sensors and a respective one of the plurality of sound level display devices, wherein the respective one of the plurality of sound level sensors in a first one of the plurality of regions determines a respective sound level within the first one of the plurality of regions for a sound originating from a source located in a second one of the plurality of regions, and wherein the respective one of the plurality of sound level display devices in the second one of the plurality of regions displays an indicator of the respective sound level within the first one of the plurality of regions.

2. The system of claim 1 wherein the respective one of the plurality of sound level sensors in the first one of the plurality of regions determines a direction of the sound, identifies the second one of the plurality of regions based on the direction of the sound, and sends data indicative of the respective sound level within the first one of the plurality of regions to the respective one of the plurality of sound level display devices in the second one of the plurality of regions, and wherein, responsive to receiving the data, the respective one of the plurality of sound level display devices in the second one of the plurality of regions displays the indicator.

3. The system of claim 1 wherein the respective one of the plurality of sound level sensors in the first one of the plurality of regions measures associated parameters of the sound and sends first data indicative of the respective sound level within the first one of the plurality of regions and the associated parameters to a control panel.

4. The system of claim 3 wherein the control panel identifies the second one of the plurality of regions based on the first data and the associated parameters and sends second data indicative of the respective sound level within the first one of the plurality of regions to the respective one of the plurality of sound level display devices in the second one of the plurality of regions, and wherein, responsive to receiving the second data, the respective one of the plurality of sound level display devices in the second one of the plurality of regions displays the indicator.

5. The system of claim 3 wherein the control panel establishes a respective threshold value for each of the plurality of regions using test signals broadcast into each of the plurality of regions.

6. The system of claim 5 wherein the control panel identifies the second one of the plurality of regions based on the first data and the associated parameters, determines whether the respective sound level within the first one of the plurality of regions exceeds the respective threshold value for the first one of the plurality of regions, and determines whether the source is controllable by the control panel.

7. The system of claim 6 wherein, when the respective sound level within the first one of the plurality of regions exceeds the respective threshold value for the first one of the plurality of regions and the source is controllable by the control panel, the control panel lowers a volume level of the source to cause the respective sound level within the first one of the plurality of regions to be lowered below the respective threshold value for the first one of the plurality of regions.

8. The system of claim 6 wherein, when the respective sound level within the first one of the plurality of regions exceeds the respective threshold value for the first one of the plurality of regions and the source is not controllable by the control panel, the control panel sends second data indicative of the respective sound level within the first one of the plurality of regions to the respective one of the plurality of sound level display devices in the second one of the plurality of regions, and responsive to receiving the second data, the respective one of the plurality of sound level display devices in the second one of the plurality of regions displays the indicator.

9. The system of claim 1 wherein each of the plurality of sound level sensors includes multiple microphones.

10. The system of claim 1 further comprising a portable user device located in the second one of the plurality of regions that displays the indicator.

11. A method comprising:

deploying a plurality of sound level sensors and a plurality of sound level display devices throughout a premises, the premises including a plurality of regions and each of the plurality of regions including a respective one of the plurality of sound level sensors and a respective one of the plurality of sound level display devices;

the respective one of the plurality of sound level sensors in a first one of a plurality of regions determining a respective sound level within the first one of the plurality of regions for a sound originating from a source located in a second one of the plurality of regions; and the respective one of the plurality of sound level display devices in the second one of the plurality of regions displaying an indicator of the respective sound level within the first one of the plurality of regions.

12. The method of claim 11 further comprising:

the respective one of the plurality of sound level sensors in the first one of the plurality of regions determining a direction of the sound;

the respective one of the plurality of sound level sensors in the first one of the plurality of regions identifying the second one of the plurality of regions based on the direction of the sound;

the respective one of the plurality of sound level sensors in the first one of the plurality of regions sending data indicative of the respective sound level within the first one of the plurality of regions to the respective one of the plurality of sound level display devices in the second one of the plurality of regions; and responsive to receiving the data, the respective one of the plurality of sound level display devices in the second one of the plurality of regions displaying the indicator.

13. The method of claim 11 further comprising the respective one of the plurality of sound level sensors in the first one of the plurality of regions measuring associated parameters of the sound and sending first data indicative of the respective sound level within the first one of the plurality of regions and the associated parameters to a control panel.

14. The method of claim 13 further comprising:

the control panel identifying the second one of the plurality of regions based on the first data and the associated parameters;

the control panel sending second data indicative of the respective sound level within the first one of the plurality of regions to the respective one of the plurality of sound level display devices in the second one of the plurality of regions; and responsive to receiving the second data, the respective one of the plurality of sound level display devices in the second one of the plurality of regions displaying the indicator.

15. The method of claim 13 further comprising the control panel establishing a respective threshold value for each of the plurality of regions by broadcasting test signals into each of the plurality of regions.

16. The method of claim 15 further comprising:

the control panel identifying the second one of the plurality of regions based on the first data and the associated parameters;

the control panel determining whether the respective sound level within the first one of the plurality of regions exceeds the respective threshold value for the first one of the plurality of regions; and the control panel determining whether the source is controllable by the control panel.

17. The method of claim 16 further comprising, when the respective sound level within the first one of the plurality of regions exceeds the respective threshold value for the first one of the plurality of regions and the source is controllable by the control panel, the control panel lowering a volume level of the source such to cause the respective sound level within the first one of the plurality of regions to be lowered below the respective threshold value for the first one of the plurality of regions.

18. The method of claim 16 further comprising:

when the respective sound level within the first one of the plurality of regions exceeds the respective threshold value for the first one of the plurality of regions and the source is not controllable by the control panel, the control panel sending second data indicative of the respective sound level within the first one of the plurality of regions to the respective one of the plurality of sound level display devices in the second one of the plurality of regions; and responsive to receiving the second data, the respective one of the plurality of sound level display devices in the second one of the plurality of regions displaying the indicator.

19. The method of claim 11 wherein each of the plurality of sound level sensors includes multiple microphones.

20. The method of claim 11 further comprising transmitting the indicator to a portable user device located in the second one of the plurality of regions.

* * * * *